US010173336B2

(12) United States Patent
Sposato, Jr. et al.

(10) Patent No.: US 10,173,336 B2
(45) Date of Patent: Jan. 8, 2019

(54) LEAD EDGE MECHANICAL BINDING DEVICE AND METHOD

(71) Applicants: John James Sposato, Jr., Dover, NH (US); Jeffery S. Upchurch, Stratham, NH (US); Jared David Kinson, Plaistow, NH (US)

(72) Inventors: John James Sposato, Jr., Dover, NH (US); Jeffery S. Upchurch, Stratham, NH (US); Jared David Kinson, Plaistow, NH (US)

(73) Assignee: Goss International Americas, Inc., Durham, NH (US)

( * ) Notice: Subject to any disclaimer, the term of this patent is extended or adjusted under 35 U.S.C. 154(b) by 324 days.

(21) Appl. No.: 14/047,387

(22) Filed: Oct. 7, 2013

(65) Prior Publication Data

US 2014/0097569 A1 Apr. 10, 2014

Related U.S. Application Data

(60) Provisional application No. 61/712,119, filed on Oct. 10, 2012.

(51) Int. Cl.

| | |
|---|---|
| ***B26D 1/40*** | (2006.01) |
| ***B41F 13/60*** | (2006.01) |
| ***B65H 35/08*** | (2006.01) |
| ***B65H 45/28*** | (2006.01) |

(52) U.S. Cl.

CPC ..... *B26D 1/405* (2013.01); *B41F 13/60* (2013.01); *B65H 35/08* (2013.01); *B65H 45/28* (2013.01); *Y10T 83/4795* (2015.04); *Y10T 83/4841* (2015.04)

(58) Field of Classification Search

CPC ..... B26D 1/405; B26D 9/00; B41F 13/60; B65H 45/24; B65H 35/08; B65H 45/28; B41G 7/006

USPC ..... 270/5.02

See application file for complete search history.

(56) References Cited

U.S. PATENT DOCUMENTS

| | | | | |
|---|---|---|---|---|
| 2,026,443 | A * | 12/1935 | Tomlin | B41F 13/54 270/42 |
| 5,186,444 | A * | 2/1993 | Palmatier | B26D 7/1818 270/21.1 |
| 5,367,936 | A * | 11/1994 | Held | B26D 1/405 83/674 |
| 6,251,053 | B1 | 6/2001 | Lanvin et al. | |
| 6,551,227 | B1 * | 4/2003 | Whitten | 493/356 |

(Continued)

FOREIGN PATENT DOCUMENTS

| | | |
|---|---|---|
| EP | 0931747 | 7/1999 |
| JP | 54122904 | 8/1979 |

*Primary Examiner* — Jennifer Simmons

(74) *Attorney, Agent, or Firm* — Davidson, Davidson & Kappel, LLC

(57) ABSTRACT

A cutting cylinder pair for cutting a substrate in a folder of a printing press is provided which includes a cutting cylinder, the cutting cylinder including a knife and a binding pin adjacent the knife in a circumferential direction of the cutting cylinder; and an anvil cylinder, the anvil cylinder including a cutting rubber, the cutting rubber engaging the knife and the binding pin as the cutting cylinder and anvil cylinder rotate, the binding pin positioned on the cutting cylinder to impart a dimple to a substrate passing between the cutting cylinder and anvil cylinder.

20 Claims, 4 Drawing Sheets

(56) References Cited

U.S. PATENT DOCUMENTS

| | | | | |
|---|---|---|---|---|
| 7,036,413 | B2 * | 5/2006 | Hartmann et al. | 83/154 |
| 2004/0058793 | A1 * | 3/2004 | Blanchard | B65H 45/28 493/432 |
| 2007/0289461 | A1 * | 12/2007 | Bernard et al. | 101/217 |
| 2011/0140340 | A1 * | 6/2011 | Spatz et al. | 270/58.08 |

* cited by examiner

LEAD EDGE MECHANICAL BINDING DEVICE AND METHOD

This application claims priority to U.S. Provisional Application Ser. No. 61/712,119 filed Oct. 10, 2012, the entire disclosure of which is hereby incorporated by reference.

BACKGROUND

The present invention relates generally to printing press and more particularly to cutting cylinders and binding devices.

As known in the art, static tackers help hold printed products closed. However, as tacker levels are increased, the delivery shingle quality deteriorates. Corrugating products helps stiffen the product but causes the lead edge to open and dog ear when the open edge aligns with a peak of a corrugation. Products configured with an exterior half page have two open edges which makes alignment with corrugation even more difficult to achieve.

BRIEF SUMMARY OF THE INVENTION

The present invention provides a binding device that applies localized pressure to a page of a printed product.

In accordance with a first embodiment of the present invention, a cutting cylinder pair for cutting a substrate in a folder of a printing press is provided. The cylinder pair includes a cutting cylinder and an anvil cylinder. The cutting cylinder includes a knife and a binding pin adjacent the knife in a circumferential direction of the cutting cylinder. The anvil cylinder includes a cutting rubber, the cutting rubber engaging the knife and the binding pin as the cutting cylinder and anvil cylinder rotate. The binding pin is positioned on the cutting cylinder to impart a dimple to a substrate passing between the cutting cylinder and anvil cylinder.

In accordance with another aspect of the first embodiment, the cutting cylinder has a circumferential outer surface, and the knife may extend axially along the circumferential outer surface. One or more additional binding pins may be provided adjacent the knife in the circumferential direction, the one or more additional binding pins extending axially along the circumferential outer surface.

In accordance with another aspect of the first embodiment, a height of the binding pin may be less than a height of the knife.

In accordance with another aspect of the first embodiment, a knife box may be removably secured to the cutting cylinder, the cutting cylinder may have an axially extending recess in a circumferential outer surface of the cutting cylinder. The knife box may be removably secured in the recess. The knife box includes the knife and the binding pin.

In accordance with other aspects of the first embodiment: the knife and/or at least one binding pin may be retractable; the binding pin(s) may be positioned at a height that applies a localized pressure to a lead edge of the substrate; the binding pin(s) may be positioned at a height that dimples the substrate; and/or the binding pin(s) may be positioned to apply a localized pressure to an open edge of the substrate.

In accordance with a second embodiment of the present invention, a cutting cylinder for cutting a substrate in a folder of a printing press is provided. The cutting cylinder includes: a knife box assembly including a knife or cutting blade and at least one binding device installed in the knife box assembly. The binding device is positioned in the knife box assembly to apply pressure to the substrate as the substrate is cut by the knife.

In accordance with another aspect of the second embodiment, the binding device includes one or more binding pins. If multiple binding pins are employed, the binding pins may be installed along a length of the knife blade.

In accordance with another aspect of the second embodiment, wherein the knife and/or at least one binding pin may be retractable.

In accordance with another aspect of the second embodiment, the binding pin(s) may be positioned at a height that applies a localized pressure to a lead edge of the substrate, the binding pin(s) may be positioned at a height that dimples the substrate, and or the binding pin(s) may be positioned to apply a localized pressure to an open edge of the substrate.

In accordance with a third embodiment of the present invention, a folder for a printing press comprising a cutting cylinder pair according to the first embodiment, a former upstream of the cutting cylinder pair, and a pair of nip rolls located between the former and the cutting cylinder pair.

In accordance with a fourth embodiment of the present invention, a printing press for printing on a substrate comprising a folder according to the third embodiment and a plurality of printing units upstream of the folder.

BRIEF DESCRIPTION OF THE DRAWINGS

A preferred embodiment of the present invention will be elucidated with reference to the drawings, in which:

FIG. 2(*b*) illustrates a binding pin positioned at an angle which is different than the angle of the knife blade in accordance with an embodiment of the present invention;

FIG. 4(*b*) shows a perspective view of a cutting cylinder with a knife box assembly installed with binding pins in accordance with an embodiment of the present invention.

DETAILED DESCRIPTION OF PREFERRED EMBODIMENTS

Static tackers need to be fine-tuned to a setting that is high enough to hold the lead edge of the product together but low enough to keep the delivery shingle clean. The former has been shifted to different positions in an attempt to find a new alignment that produces a better corrugation on the full and half page sheets.

The present invention provides a binding device that eliminates the need to increase the static tacker strength and could potentially eliminate the need for a static tacker completely.

Figure 1:
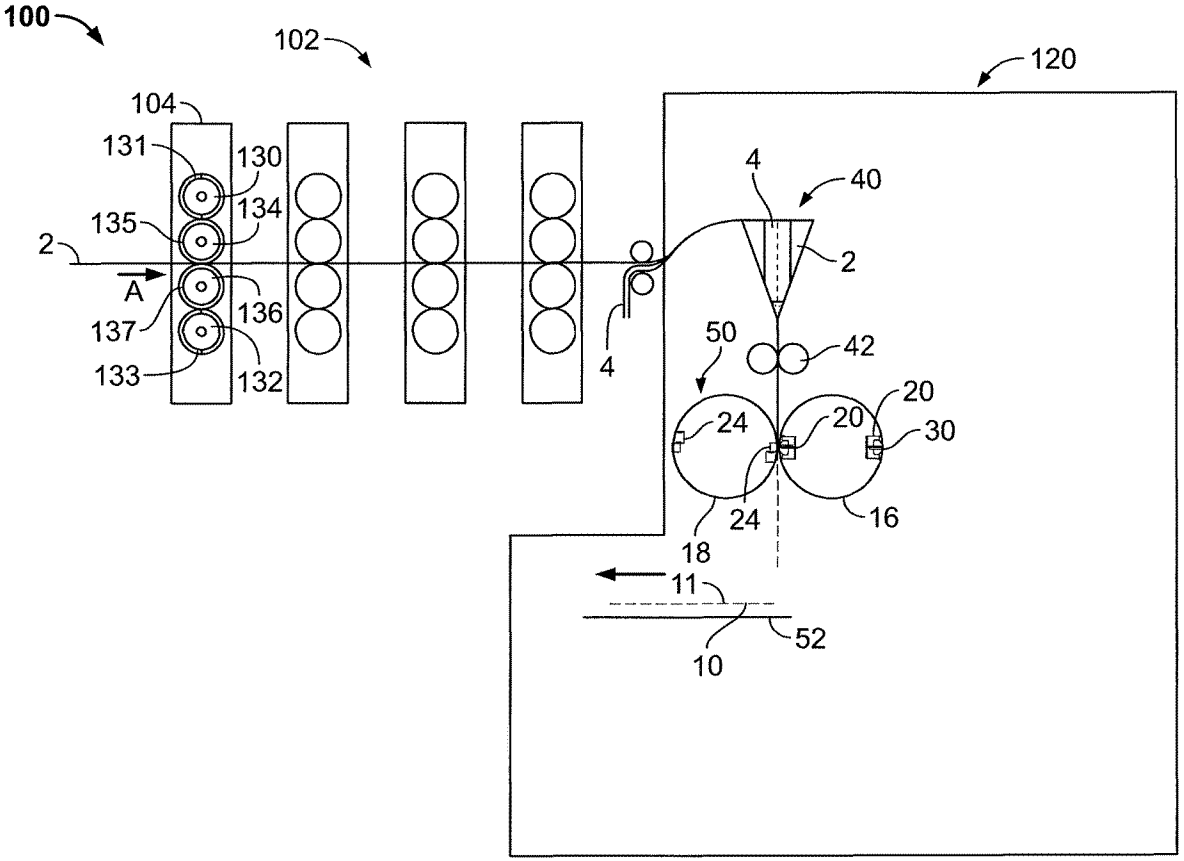
FIG. 1 shows a printing press including a binding device according to the present invention.

FIG. 1 shows a printing press 100 including a printing section 102 and a folder section 120 for printing, cutting and folding printed products, such as newspapers, for example.

The printing press 100 may be a perfecting, web offset, four color printing press. Printing press 100 may include four printing units 104 each printing on a web 2 with a different color ink, for example, cyan, magenta, yellow and black. Web 2 travels through press 100 in a direction A from printing section 102 to folder section 120. Each printing unit 104 may include two printing cylinders 130, 132 and two blanket cylinders 134, 136. Each printing cylinder 130, 132 carries a printing plate 131, 133 mounted thereon. Alternatively, the printing cylinders 130, 132 may be etched or imaged directly with a printing image. Each blanket cylinder 134, 136 includes a printing blanket 135, 137 mounted thereon. The printing blankets 135, 137 may be flat blankets mounted into a lockup mechanism or printing blankets 135, 137 may be tubular, gapless, sleeve-shaped blankets. The printing plates 131, 313 transfer images to printing blankets 135, 137 which transfer images to web 2.

Figure 5:
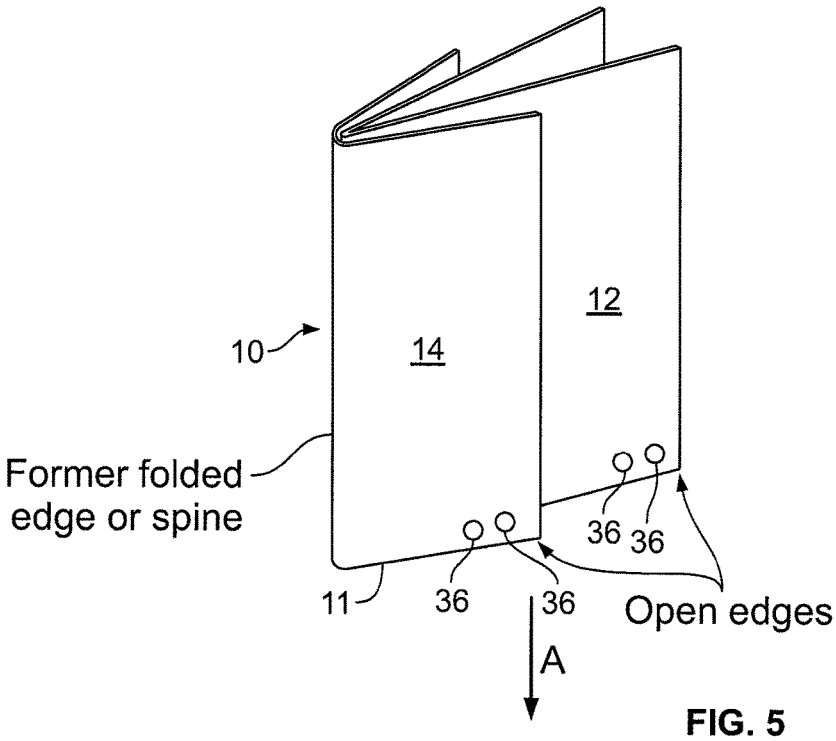
FIG. 5 shows a product formed in accordance with an embodiment of the present invention.

From the printing section 102, web 2 then enters folder section 120. Folder section 120 includes a triangular shaped former 40 for folding web 2. Web 2 may also be combined with other web ribbons for simultaneous folding. Additional ribbons may be printed by another printing section or by another printing press, for example web 4. In this embodiment, web 4 is a half sheet size web and thus is narrower than full sheet size web 2. Web 4 is combined with web 2 so web 4 is centered and overlaid on top of web 2. Former 40 folds web 2 and web 4 together and in half as webs 2, 4 run down a surface of former 40. Webs 2, 4 are folded in half longitudinally, in the direction of travel A. Webs 2, 4 may pass through a pair of nip rolls 42. As shown in FIG. 5, a printed product or book 10 is made from the two webs, full size web 2 which forms inner signature 12 and half sheet size web 4 which forms outer signature 14.

Webs 2, 4 are then cut together by a cutting cylinder pair 50. Cutting cylinder pair 50 includes an anvil cylinder 18 and knife cylinder 16. In the embodiment shown, knife cylinder 16 is a two around knife cylinder and includes two knife box assemblies 20. Anvil cylinder 18 is a two around anvil cylinder and includes two cutting rubber assemblies 24. Each knife box assembly 20 includes a binding device 30 in accordance with a preferred embodiment of the present invention as well as a knife 22. Any number of knife boxes 20/cutting rubber assemblies 24 may be provided as desired on cylinders 16/18.

Figure 2A:
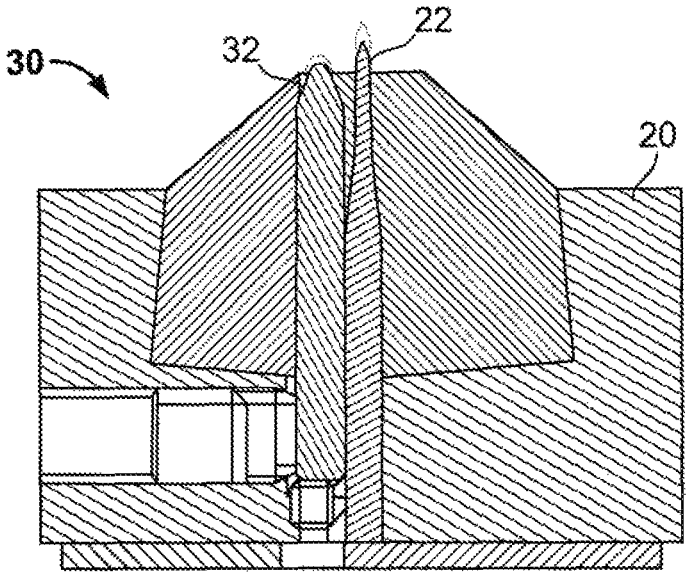
FIG. 2(*a*) shows a cross sectional view of a knife box assembly of a cutting cylinder in accordance with an embodiment of the present invention.
Figure 2B:
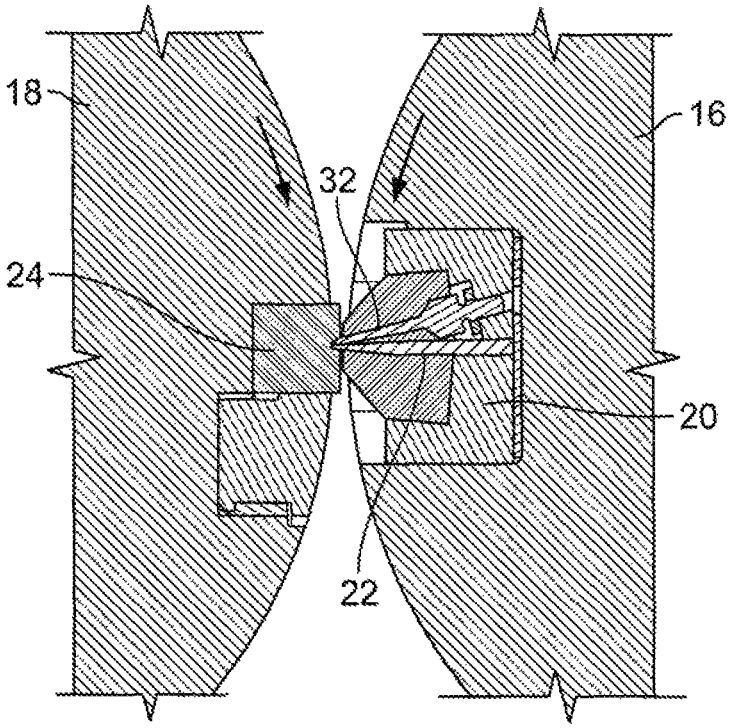
Figure 3:
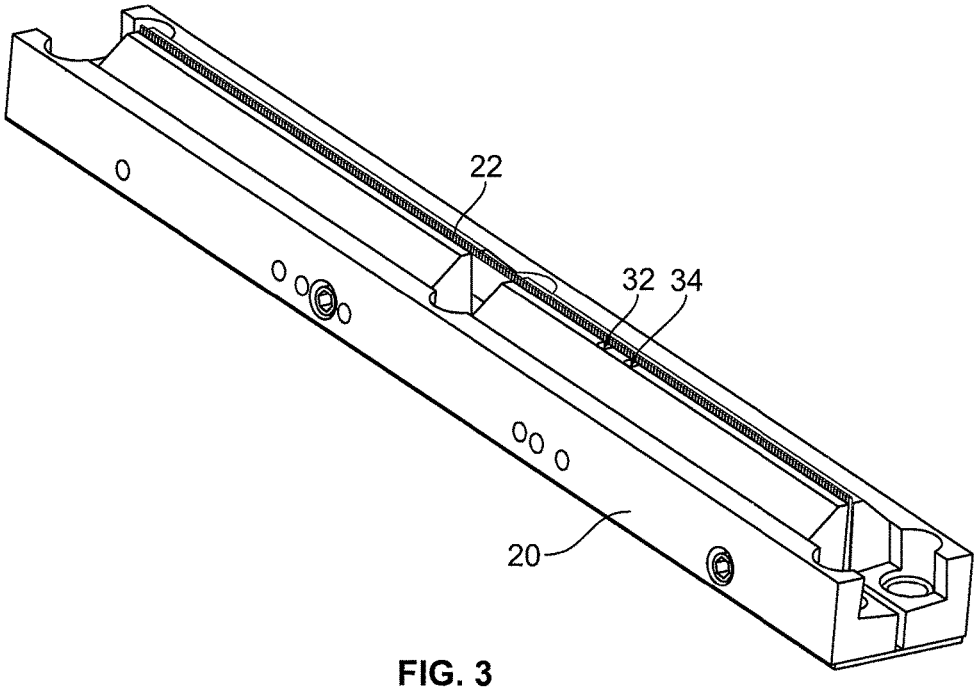
FIG. 3 shows a view of a knife box assembly including two binding pins in accordance with an embodiment of the present invention.
Figure 4A:
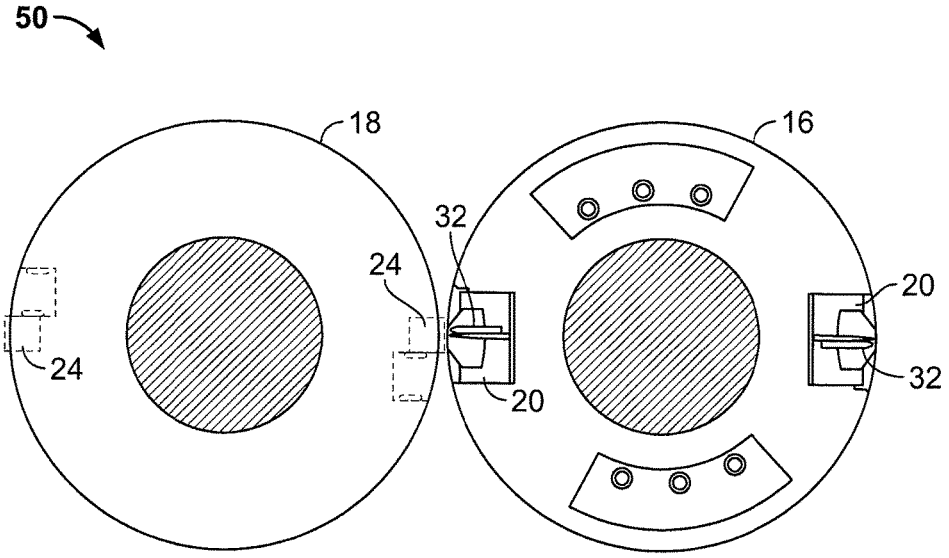
FIG. 4(*a*) shows a side view of a pair of cutting cylinders with an anvil, knife box, and binding pins in accordance with an embodiment of the present invention.
Figure 4B:
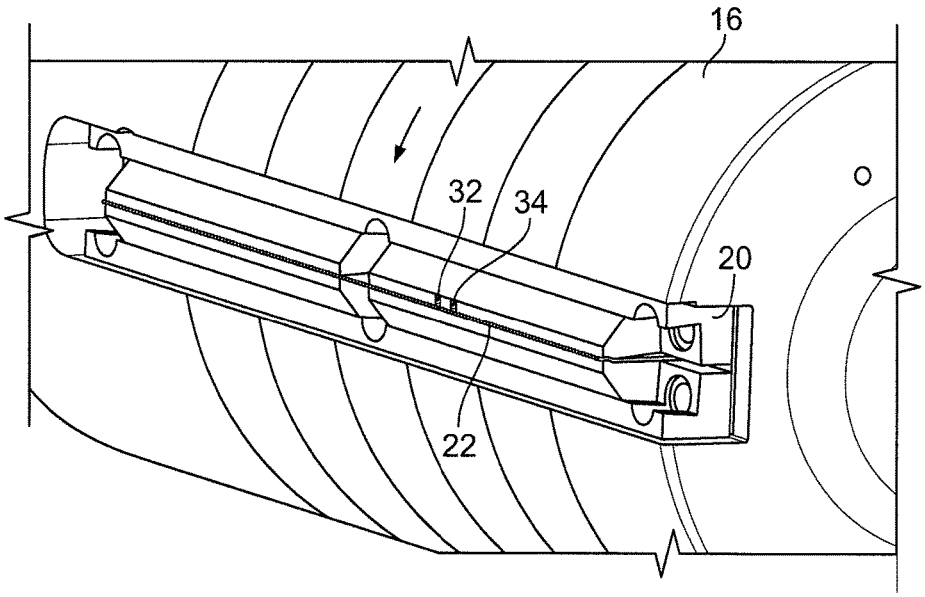

FIGS. 2 to 4 show binding device 30 in accordance with the present invention. Binding device 30 is installed along a length of knife 22 on the lead edge side (with respect to the direction of travel A), inside knife box assembly 20. As cutting cylinder 16 rotates and webs 2, 4 are cut, a binding pin 32 of binding device 30 dimples a lead edge 11 (FIGS. 1, 5) of webs 2, 4 against a cutting rubber 24. The localized pressure dimples 36 and binds pages of newly cut product 10 together, holding a lead edge 11 of product 10 closed as product 10 travels through folder 120, thereby reducing dog earring and other printing defects. Product 10 includes a signature 14 cut from web 4 and a signature 12 cut from web 2. Multiple binding pins 32 may be located along knife 22 for dimpling across a product 10 to bind any size product, including half page sized signatures 14.

FIG. 2(*a*) shows a cross sectional view of a knife box assembly 20 of cutting cylinder 16. Binding device 30 includes binding pin 32 that is installed in the knife box assembly 20 adjacent to knife 22. Multiple binding pins may be provided. Binding pin 32 may be mechanically set at a desired height. The height of binding pin 32 is adjustable and may be equal to, greater than or less than a height of knife blade 22. The angle of the binding pin can be the same or different than the knife blade angle. FIG. 2(*b*) illustrates a binding pin 32 positioned at an angle which is different than the angle of the knife blade 22.

In a preferred embodiment, binding pin 32 is set to a height less than a height of knife blade 22. The thickness of the printed product or book being cut is considered when determining the set height for binding pin 32. The height of each binding pin may be set individually. For example, when viewing FIG. 5, a binding pin dimpling signatures 14 and 12 together may be set to a lower height than a binding pin setup to dimple only signature 12.

If the binding pin 32 is instead set to a height greater than the knife 22, a recess may be provided in the cutting rubber so that the presence of the binding pin does not interfere with the cutting action of the knife 22.

In accordance with a preferred embodiment of the present invention, binding pins 32 apply dimpling to signatures 12, 14 without causing commercially unacceptable damage to signatures 12, 14. Binding pins 32 may be made out of, for example, steel.

FIG. 3 shows a view of knife box assembly 20 including two binding pins 32, 34 in accordance with a further preferred embodiment of the present invention. Additional pins and/or additional pin positions may be installed along a length of knife blade 22 to achieve the desired binding effect. Binding pins 32, 34 may be arranged to bind open edges of a half page product (signature 14), full page product (signature 12) and any combination thereof. Binding pins and knife blades may be fixed. Binding pins and knife blades may also be adjustably set at a plurality heights as desired. Binding pins and/or knife blades may also be retractable and/or controlled via a cam mechanism.

FIG. 4(*a*) shows a side view of a pair of cutting cylinders. Cutting cylinder 16 includes two knife box assemblies 20 having two binding devices 30 with binding pins 32 installed. Each knife box assembly 20 includes a binding device 30 and associated binding pins 32. Anvil cylinder 18 includes two cutting rubbers 24 which are used to counteract knife blades 22 and binding pins 32. Cutting cylinder 16 may be retrofitted with a knife box assembly 20 which includes binding pins 32 to replace previous knife box assemblies. FIG. 4(*b*) shows a perspective view of a cutting cylinder 16 with a knife box assembly 20 installed with knife blade 22 and binding pins 32, 34.

FIG. 5 shows a half page size signature 14 wrapped folded around a full page size signature 12 to form a book or printed product 10. Open edges are indicated as is the "spine" or former folded edge of the product 10 and the lead edge 11 of product 10 is shown. The spine of the product is formed by the longitudinal fold imparted by former 40. Dimples 36 made on signatures 12, 14 in accordance with the present invention are shown. Binding pins 32, 34 may impart dimples on any number of pages as desired.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A cutting cylinder pair for cutting a substrate in a folder of a printing press, comprising a cutting cylinder, the cutting cylinder including a knife and a binding pin adjacent the knife in a circumferential direction of the cutting cylinder;

an anvil cylinder, the anvil cylinder including a cutting rubber, the cutting rubber engaging the knife and the binding pin as the cutting cylinder and anvil cylinder rotate, the binding pin positioned on the cutting cylinder to impart a dimple to a substrate passing between the cutting cylinder and anvil cylinder;

wherein the height of the binding pin is adjustable independent of the height of the knife.

2. The cutting cylinder pair of claim 1, wherein the cutting cylinder has a circumferential outer surface, wherein the knife extends axially along the circumferential outer surface, and further comprising one or more additional binding pins adjacent the knife in the circumferential direction, the one or more additional binding pins extending axially along the circumferential outer surface.

3. The cutting cylinder pair of claim 1, wherein a height of the binding pin is less than a height of the knife.

4. The cutting cylinder pair of claim 1, further comprising a knife box removably secured to the cutting cylinder, the cutting cylinder having an axially extending recess in a circumferential outer surface of the cutting cylinder, the knife box removably secured in the recess, the knife box including the knife and the binding pin.

5. The cutting cylinder pair of claim 4, wherein the knife extends axially along the circumferential outer surface, and further comprising one or more additional binding pins adjacent the knife in the circumferential direction, the one or more additional binding pins extending axially along the circumferential outer surface.

6. The cutting cylinder pair of claim 1 wherein the knife and/or the binding pin is retractable.

7. The cutting cylinder pair of claim 6, wherein both the knife and the binding pin are retractable.

8. The cutting cylinder pair of claim 1 wherein the binding pin is positioned at a height that applies a localized pressure to a lead edge of the substrate.

9. The cutting cylinder pair of claim 1 wherein the binding pin is positioned at a height that dimples the substrate.

10. The cutting cylinder pair of claim 1 wherein the binding pin is positioned to apply a localized pressure to an open edge of the substrate.

11. A folder for a printing press comprising a cutting cylinder pair according to claim 1, a former upstream of the cutting cylinder pair, and a pair of nip rolls located between the former and the cutting cylinder pair.

12. A printing press for printing on a substrate comprising a folder according to claim 11 and a plurality of printing units upstream of the folder.

13. A cutting cylinder pair for cutting a substrate in a folder of a printing press, comprising:

a cutting cylinder, the cutting cylinder including a knife and a binding pin adjacent the knife in a circumferential direction of the cutting cylinder;

an anvil cylinder, the anvil cylinder including a cutting rubber, the cutting rubber engaging the knife and the binding pin as the cutting cylinder and anvil cylinder rotate, the binding pin positioned on the cutting cylinder to impart a dimple to a substrate passing between the cutting cylinder and anvil cylinder, wherein the height of the binding pin and the height of the knife are independently adjustable.

14. The cutting cylinder pair of claim 13 wherein the cutting cylinder includes one binding pin.

15. The cutting cylinder pair of claim 13 wherein the cutting cylinder includes two binding pins.

16. The cutting cylinder pair of claim 13 wherein the height of the binding pin may be set individually.

17. The cutting cylinder pair of claim 13 wherein the cutting rubber has a recessed groove.

18. The cutting cylinder pair of claim 15 wherein the height of each binding pin may be set individually.

19. A cutting cylinder pair for cutting a substrate in a folder of a printing press, comprising:

a cutting cylinder, the cutting cylinder including a knife and a binding pin adjacent the knife in a circumferential direction of the cutting cylinder;

an anvil cylinder, the anvil cylinder including a cutting rubber, the cutting rubber engaging the knife and the binding pin as the cutting cylinder and anvil cylinder rotate, the binding pin positioned on the cutting cylinder to impart a dimple to a substrate passing between the cutting cylinder and anvil cylinder, wherein the cutting cylinder is configured and arranged to accommodate the placement of the binding pin and the knife at multiple angles between each other when the binding pin is in an operational position.

20. The cutting cylinder pair of claim 19 wherein the height of the binding pin may be set individually.

* * * * *